US007423550B2

(12) United States Patent
Reckmann et al.

(10) Patent No.: US 7,423,550 B2
(45) Date of Patent: Sep. 9, 2008

(54) TWO SENSOR IMPEDANCE ESTIMATION FOR UPLINK TELEMETRY SIGNALS

(75) Inventors: Hanno Reckmann, Wathlingen (DE); Michael Neubert, Braunschweig (DE); Ingolf Wassermann, Hannover (DE)

(73) Assignee: Baker Hughes Incorporated, Houston, TX (US)

( * ) Notice: Subject to any disclaimer, the term of this patent is extended or adjusted under 35 U.S.C. 154(b) by 399 days.

(21) Appl. No.: 11/311,196

(22) Filed: Dec. 19, 2005

(65) Prior Publication Data

US 2006/0132328 A1 Jun. 22, 2006

Related U.S. Application Data

(63) Continuation-in-part of application No. 11/018,344, filed on Dec. 21, 2004, now abandoned.

(51) Int. Cl.
*G01V 1/00* (2006.01)

(52) U.S. Cl. ..... 340/855.7; 367/82; 367/83; 340/855.4; 340/855.5

(58) Field of Classification Search ..... 340/853.2, 340/855.7, 854.3, 856.4, 855.4, 855.5, 855.6; 367/82, 83

See application file for complete search history.

(56) References Cited

U.S. PATENT DOCUMENTS

| | | | | |
|---|---|---|---|---|
| 3,716,830 | A | 2/1973 | Garcia | 340/18 LD |
| 3,742,443 | A | 6/1973 | Foster et al. | 340/18 LD |
| 3,747,059 | A | 7/1973 | Garcia | 340/18 LD |
| 4,262,343 | A | 4/1981 | Claycomb | 367/83 |
| 4,590,593 | A | 5/1986 | Rodney | 367/83 |
| 4,642,800 | A | 2/1987 | Umeda | 367/85 |
| 4,692,911 | A | 9/1987 | Scherbatskoy | 367/83 |
| 4,715,022 | A | 12/1987 | Yeo | 367/83 |
| 5,113,379 | A | 5/1992 | Scherbatskoy | 367/83 |
| 5,146,433 | A | 9/1992 | Kosmala et al. | 367/83 |
| 5,969,638 | A | 10/1999 | Chin | 340/855.3 |
| 6,370,082 | B1 | 4/2002 | Gardner et al. | 367/82 |
| 6,626,253 | B2 | 9/2003 | Hahn et al. | 175/48 |
| 6,741,185 | B2 | 5/2004 | Shi et al. | 340/853.2 |
| RE38,567 | E | 8/2004 | Gruenhagen | 340/679 |
| 7,324,010 | B2 * | 1/2008 | Gardner et al. | 340/854.4 |

FOREIGN PATENT DOCUMENTS

GB 2361789 A 10/2001

* cited by examiner

*Primary Examiner*—Albert K. Wong
*Assistant Examiner*—Hung Q Dang
(74) *Attorney, Agent, or Firm*—Madan, Mossman & Sriram, P.C.

(57) ABSTRACT

Measurements made with dual sensors (flow rate or pressure) are used to attenuate pump noise in a mud pulse telemetry system.

25 Claims, 6 Drawing Sheets

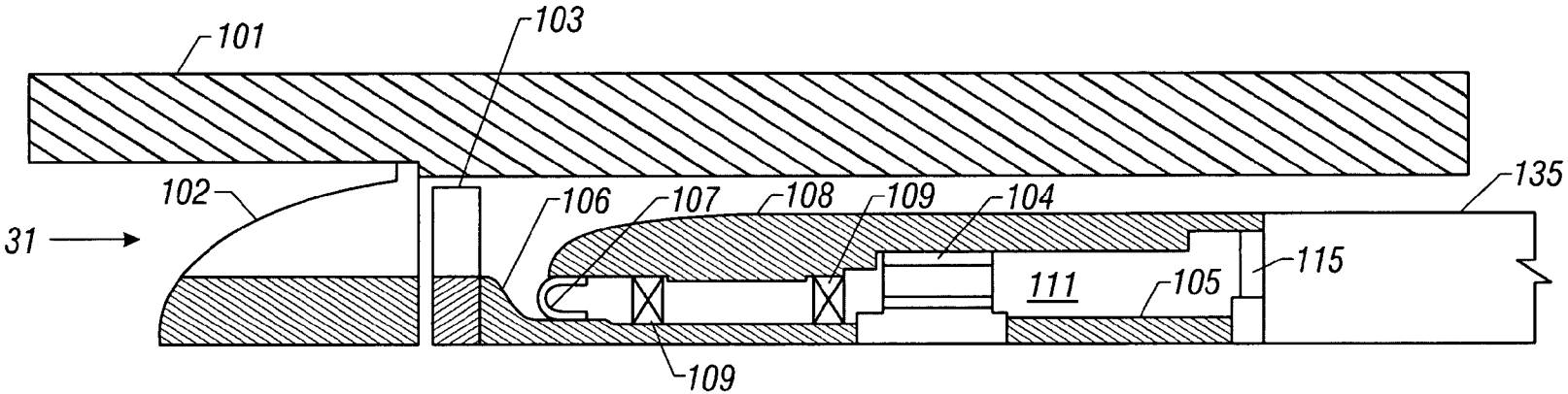
FIG. 2A
(Prior Art)
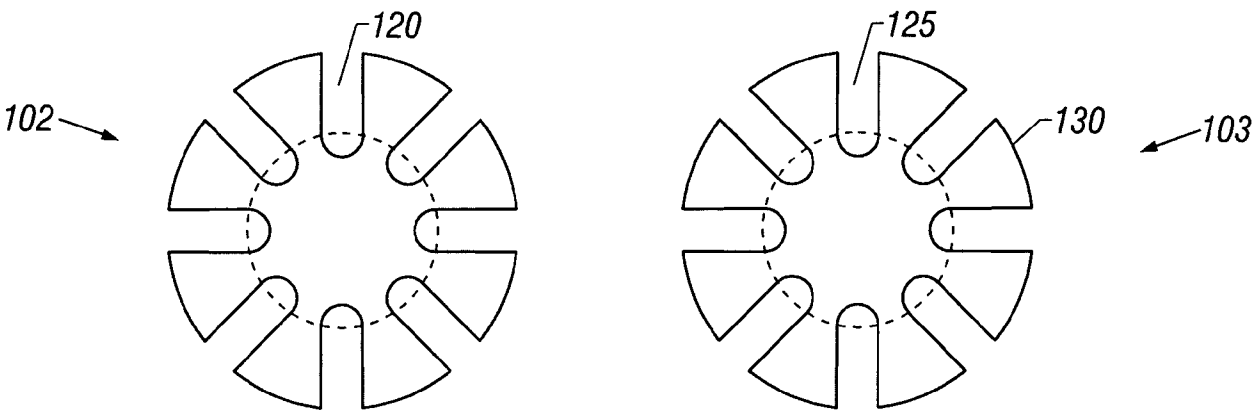
FIG. 2C
(Prior Art)
FIG. 2B
(Prior Art)

TWO SENSOR IMPEDANCE ESTIMATION FOR UPLINK TELEMETRY SIGNALS

CROSS-REFERENCES TO RELATED APPLICATIONS

This application is a continuation-in-part of U.S. patent application Ser. No. 11/018,344 filed on 21 Dec. 2004 now abandoned.

BACKGROUND OF THE INVENTION

1. Field of the Invention

The present invention relates to telemetry systems for communicating information from a downhole location to a surface location, and, more particularly, to a method of removing noise at the surface location produced by surface sources.

2. Description of the Related Art

Drilling fluid telemetry systems, generally referred to as mud pulse systems, are particularly adapted for telemetry of information from the bottom of a borehole to the surface of the earth during oil well drilling operations. The information telemetered often includes, but is not limited to, parameters of pressure, temperature, direction and deviation of the well bore. Other parameter include logging data such as resistivity of the various layers, sonic density, porosity, induction, self potential and pressure gradients. This information is critical to efficiency in the drilling operation.

MWD Telemetry is required to link the downhole MWD components to the surface MWD components in real-time, and to handle most drilling related operations without breaking stride. The system to support this is quite complex, with both downhole and surface components that operate in step.

In any telemetry system there is a transmitter and a receiver. In MWD Telemetry the transmitter and receiver technologies are often different if information is being uplinked or down-linked. In up-linking, the transmitter is commonly referred to as the Mud-Pulser (or more simply the Pulser) and is an MWD tool in the BHA that can generate pressure fluctuations in the mud stream. The surface receiver system consists of sensors that measure the pressure fluctuations and/or flow fluctuations, and signal processing modules that interpret these measurements.

Down-linking is achieved by either periodically varying the flow-rate of the mud in the system or by periodically varying the rotation rate of the drillstring. In the first case, the flow rate is controlled using a bypass-actuator and controller, and the signal is received in the downhole MWD system using a sensor that is affected by either flow or pressure. In the second case, the surface rotary speed is controlled manually, and the signal is received using a sensor that is affected.

For uplink telemetry, a suitable pulser is described in U.S. Pat. No. 6,626,253 to *Hahn* et al., having the same assignee as the present application and the contents of which are fully incorporated herein by reference. Described in Hahn '253 is an anti-plugging oscillating shear valve system for generating pressure fluctuations in a flowing drilling fluid. The system includes a stationary stator and an oscillating rotor, both with axial flow passages. The rotor oscillates in close proximity to the stator, at least partially blocking the flow through the stator and generating oscillating pressure pulses. The rotor passes through two zero speed positions during each cycle, facilitating rapid changes in signal phase, frequency, and/or amplitude facilitating enhanced data encoding.

U.S. Pat. No. RE 38,567 to Gruenhagen et al., having the same assignee as the present invention and the contents of which are fully incorporated herein by reference, and U.S. Pat. No. 5,113,379 to Scherbatskoy teach methods of downlink telemetry in which flow rate is controlled using a bypass-actuator and controller.

Drilling systems (described below) include mud pumps for conveying drilling fluid into the drillstring and the borehole. Pressure waves from surface mud pumps produce considerable amounts of noise. The pump noise is the result of the motion of the mud pump pistons. The pressure waves from the mud pumps travel in the opposite direction from the uplink telemetry signal. Components of the noise waves from the surface mud pumps may be present in the frequency range used for transmission of the uplink telemetry signal and may even have a higher level than the received uplink signal, making correct detection of the received uplink signal very difficult. Additional sources of noise include the drilling motor and drill bit interaction with the formation. All these factors degrade the quality of the received uplink signal and make it difficult to recover the transmitted information.

There have been numerous attempts to find solutions for reducing interfering effects in MWD telemetry signals. U.S. Pat. Nos. 3,747,059 and 3,716,830 to Garcia teach methods of reducing the effect of mud pump noise wave reflecting off the flexible hose; other reflections or distortions of the noise or signal waves are not addressed.

U.S. Pat. No. 3,742,443 to Foster et al. teaches a noise reduction system that uses two spaced apart pressure sensors. The optimum spacing of the sensors is one-quarter wavelength at the frequency of the telemetry signal carrier. The signal from the sensor closer to the mud pumps is passed through a filter having characteristics related to the amplitude and phase distortion encountered by the mud pump noise component as it travels between the two spaced points. The filtered signal is delayed and then subtracted from the signal derived from the sensor further away from the mud pumps. The combining function leads to destructive interference of the mud pump noise and constructive interference of the telemetry signal wave, because of the one-quarter wavelength separation between the sensors. The combined output is then passed through another filter to reduce distortion introduced by the signal processing and combining operation. The system does not account for distortion introduced in the telemetry signal wave as it travels through the mud column from the downhole transmitter to the surface sensors. The filter on the combined output also assumes that the mud pump noise wave traveling from the mud pumps between the two sensors encounters the same distortion mechanisms as the telemetry signal wave traveling in the opposite direction between the same pair of sensors. This assumption does not, however, always hold true in actual MWD systems.

U.S. Pat. No. 4,262,343 to Claycomb discloses a system in which signals from a pressure sensor and a fluid velocity detector are combined to cancel mud pump noise and enhance the signal from downhole. U.S. Pat. No. 4,590,593 to Rodney discloses a two sensor noise canceling system similar to those of Garcia and Foster et al., but with a variable delay. The delay is determined using a least mean squares algorithm during the absence of downhole data transmission. U.S. Pat. No. 4,642,800 issued to Umeda discloses a noise-reduction scheme that includes obtaining an "average pump signature" by averaging over a certain number of pump cycles. The assumption is that the telemetry signal is not periodic with the same period as the pump noise and, hence, will average to zero. The pump signature is then subtracted from the incoming signal to leave a residual that should contain mostly telemetry signal. U.S. Pat. No. 5,146,433 to Kosmala et al. uses signals from position sensors on the mud pumps as inputs to a system that relates the mud pump pressure to the position of the pump pistons.

Thus, the mud pump noise signature is predicted from the positions of the pump pistons. The predicted pump noise signature is subtracted from the received signal to cancel the pump noise component of the received signal.

U.S. Pat. No. 4,715,022 to Yeo discloses a signal detection method for mud pulse telemetry systems using a pressure transducer on the gas filled side of the pulsation dampener to improve detection of the telemetry wave in the presence of mud pump noise. One of the claims includes a second pressure transducer on the surface pipes between the dampener and the drill string and a signal conditioner to combine the signals from the two transducers. Yeo does not describe how the two signals may be combined to improve signal detection.

U.S. Pat. No. 4,692,911 to Scherbatskoy discloses a scheme for reducing mud pump noise by subtracting from the received signal, the signal that was received T seconds previously, where T is the period of the pump strokes. The received signal comes from a single transducer. A delay line is used to store the previous noise pulse from the mud pumps and this is then subtracted from the current mud pump noise pulse. This forms a comb filter with notches at integer multiples of the pump stroke rate. The period T of the mud pumps may be determined from the harmonics of the mud pump noise, or from sensors placed on or near the mud pumps. The telemetry signal then needs to be recovered from the output of the subtraction operation (which includes the telemetry signal plus delayed copies of the telemetry signal).

U.S. Pat. No. 5,969,638 to Chin discloses a signal processor for use with MWD systems. The signal processor combines signals from a plurality of signal receivers on the standpipe, spaced less than one-quarter wavelength apart to reduce mud pump noise and reflections traveling in a downhole direction. The signal processor isolates the derivative of the forward traveling wave, i.e., the wave traveling up the drill string, by taking time and spatial derivatives of the wave equation. Demodulation is then based on the derivative of the forward traveling wave. The signal processor requires that the signal receivers be spaced a distance of five to fifteen percent of a typical wavelength apart.

All the aforementioned prior art systems are attempting to find a successful solution that would eliminate a substantial portion or all of the mud pump noise measured by transducers at the surface and, in so doing, improve reception of telemetry signals transmitted ftom downhole. Some of these systems also attempt to account for reflected waves traveling back in the direction of the source of the original waves. However, none provide means for substantially reducing mud pump noise while also dealing with distortion caused by the mud channel and reflected waves.

GB 2361789 to Tennent et al. teaches a receiver and a method of using the receiver for use with a mud-pulse telemetry system. The receiver comprises at least one instrument for detecting and generating signals in response to a telemetry wave and a noise wave traveling opposite the telemetry wave, the generated signals each having a telemetry wave component and a noise wave component. A filter receives and combines the signals generated by the instruments to produce an output signal in which the noise wave component is filtered out. An equalizer reduces distortion of the telemetry wave component of the signals. The teachings of Tennent include correcting for a plurality of reflectors that, in combination with the uplink and mud pump signals, affect that received signals. In essence, Tennent determines a transfer function for the mud channel in both directions. Determination of these transfer functions is difficult when both the mud pump and the downhole pulser are operating. The present invention addresses this difficulty with a simple solution.

SUMMARY OF THE INVENTION

One embodiment of the present invention is a method of communicating a signal through a fluid in a borehole between a downhole location and a surface location. First and second signals are measured at spaced apart first and second positions at or near the surface in response to operation of a noise source and/or a message source at the downhole location. A transfer function of the fluid between the first and second positions is determined from the first and second signals. A message signal is generated at the downhole location simultaneously with operation of the noise source. Third and fourth signals are measured at the first and second positions responsive to the message signal and the simultaneous operation of the noise source. The message signal is then estimated from the third and fourth signals and the estimated transfer function. The measured signals may be pressure signals and/or flow rate signals. The noise source may be a pump, a drilling motor, or a drill bit. The estimation of the transfer function may be based on application of a unitary transform such as a Fourier transform. The estimation of the message signal may be based on differential filtering. The message signal may be a swept frequency signal.

Another embodiment of the invention is a system for communicating a signal through a fluid in a borehole between a bottomhole assembly (BHA) and a surface location. The system includes a message source on the bottomhole assembly (BHA) capable of generating a message signal. First and second sensors are positioned at spaced apart first and second locations and measure first and second signals in response to operation of a noise source and/or the message source. The first and second sensor measure third and fourth signals in response to generation of a message signal simultaneously with operation of the noise source. A processor determines a characteristic of the channel between the first and second sensors from the first and second signals, and then uses this determined characteristic in combination with the third and fourth signals to estimate the message signal. The first and second signals may be pressure signals or flow rate signals. The noise source may be a pump or any other noise source on the opposite side of the first and second sensors from the source of the message signal.

The determined characteristic of the fluid may be a transfer function between the first and second positions. The processor may apply a unitary transform such as a Fourier transform in determining the transfer function. A differential filtering may be applied by the processor for estimating the message signal. The message signal may involve ASK, FSK or PSK. The message source may include a downhole pulser including an oscillating valve.

Another embodiment of the invention is a machine readable medium for use in conjunction with a bottomhole assembly (BHA) conveyed in a borehole in an earth formation. The medium includes instructions for estimating from first and second signals in a fluid at spaced apart first and second positions at or near a surface location in response to operation of at least one of (A) a noise source, and, (B) a message source at the downhole location a characteristic of the fluid between the first and second positions. Instructions are also included for estimating a value of a message signal generated at the BHA simultaneously with operation of the noise source from third and fourth signals measured at the first and second positions responsive to the message signal and the simultaneous operation of the noise source, and the estimated fluid characteristic. The machine readable medium may be a ROM, an EPROM, an EAROM, a Flash Memory, and/or an Optical disk. The medium may include instructions for generating the message signal in response to a measurement of a parameter of the BHA and/or a measurement of a property of the earth formation.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein:

FIGS. 2*a*-2*c* (prior art) is a schematic of an oscillating shear valve suitable for use with the present invention;

DETAILED DESCRIPTION OF THE INVENTION

Figure 1:
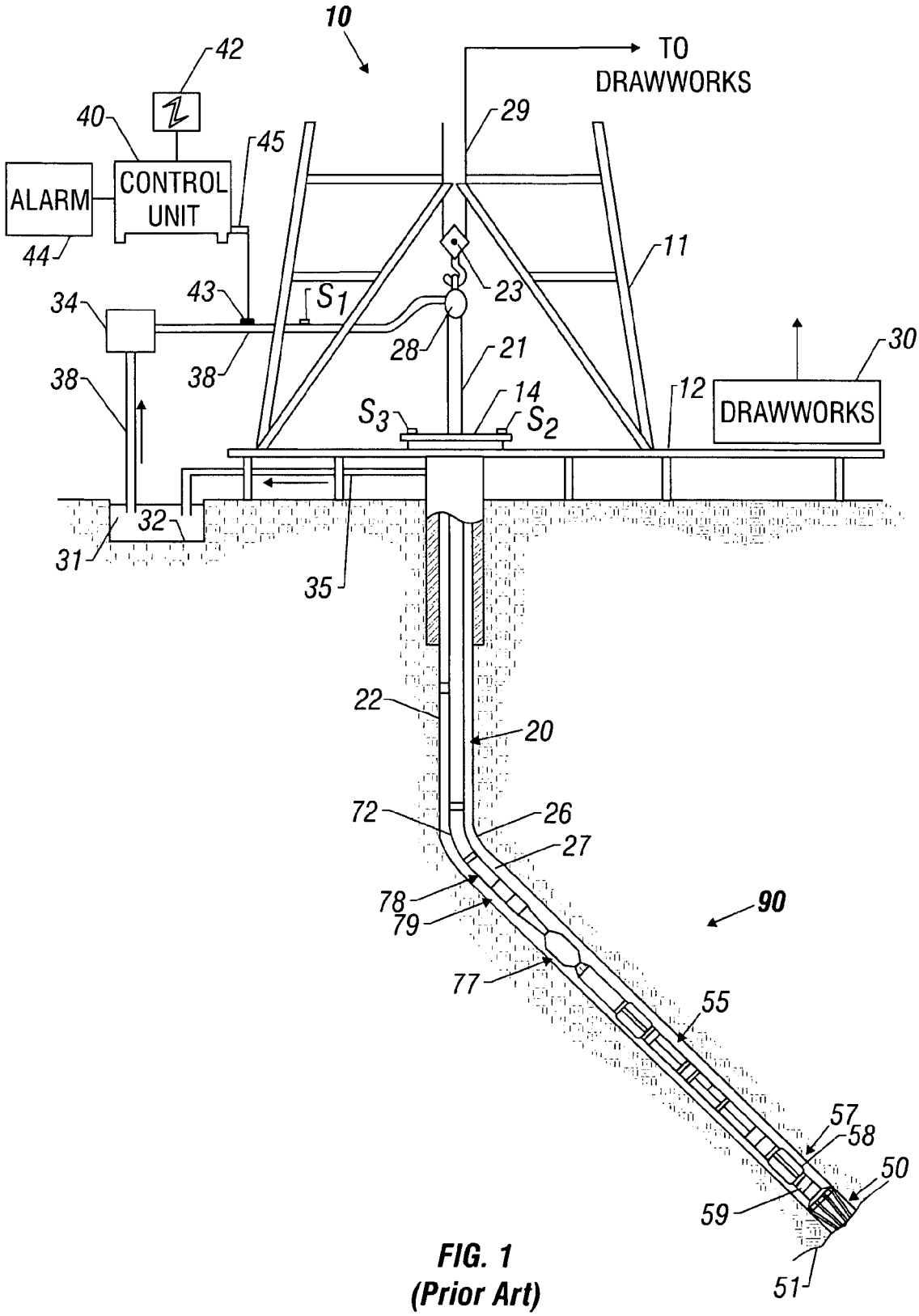
FIG. 1 (Prior Art)
FIG. 1 (prior art) is a schematic illustration of a drilling system suitable for use with the present invention.

FIG. 1 shows a schematic diagram of a drilling system 10 with a drillstring 20 carrying a drilling assembly 90 (also referred to as the bottom hole assembly, or "BHA") conveyed in a "wellbore" or "borehole" 26 for drilling the wellbore. The drilling system 10 includes a conventional derrick 11 erected on a floor 12 which supports a rotary table 14 that is rotated by a prime mover such as an electric motor (not shown) at a desired rotational speed. The drillstring 20 includes a tubing such as a drill pipe 22 or a coiled-tubing extending downward from the surface into the borehole 26. The drillstring 20 is pushed into the wellbore 26 when a drill pipe 22 is used as the tubing. For coiled-tubing applications, a tubing injector, such as an injector (not shown), however, is used to move the tubing from a source thereof, such as a reel (not shown), to the wellbore 26. The drill bit 50 attached to the end of the drillstring breaks up the geological formations when it is rotated to drill the borehole 26. If a drill pipe 22 is used, the drillstring 20 is coupled to a drawworks 30 via a Kelly joint 21, swivel 28, and line 29 through a pulley 23. During drilling operations, the drawworks 30 is operated to control the weight on bit, which is an important parameter that affects the rate of penetration. The operation of the drawworks is well known in the art and is thus not described in detail herein.

During drilling operations, a suitable drilling fluid 31 from a mud pit (source) 32 is circulated under pressure through a channel in the drillstring 20 by a mud pump 34. The drilling fluid passes from the mud pump 34 into the drillstring 20 via a desurger (not shown), fluid line 38 and Kelly joint 21. The drilling fluid 31 is discharged at the borehole bottom 51 through an opening in the drill bit 50. The drilling fluid 31 circulates uphole through the annular space 27 between the drillstring 20 and the borehole 26 and returns to the mud pit 32 via a return line 35. The drilling fluid acts to lubricate the drill bit 50 and to carry borehole cutting or chips away from the drill bit 50. A sensor $S_1$ typically placed in the line 38 provides information about the fluid flow rate. A surface torque sensor $S_2$ and a sensor $S_3$ associated with the drillstring 20 respectively provide information about the torque and rotational speed of the drillstring. Additionally, a sensor (not shown) associated with line 29 is used to provide the hook load of the drillstring 20.

In one embodiment of the invention, the drill bit 50 is rotated by only rotating the drill pipe 22. In another embodiment of the invention, a downhole motor 55 (mud motor) is disposed in the drilling assembly 90 to rotate the drill bit 50 and the drill pipe 22 is rotated usually to supplement the rotational power, if required, and to effect changes in the drilling direction.

In an exemplary embodiment of FIG. 1, the mud motor 55 is coupled to the drill bit 50 via a drive shaft (not shown) disposed in a bearing assembly 57. The mud motor rotates the drill bit 50 when the drilling fluid 31 passes through the mud motor 55 under pressure. The bearing assembly 57 supports the radial and axial forces of the drill bit. A stabilizer 58 coupled to the bearing assembly 57 acts as a centralizer for the lowermost portion of the mud motor assembly.

In one embodiment of the invention, a drilling sensor module 59 is placed near the drill bit 50. The drilling sensor module contains sensors, circuitry and processing software and algorithms relating to the dynamic drilling parameters. Such parameters typically include bit bounce, stick-slip of the drilling assembly, backward rotation, torque, shocks, borehole and annulus pressure, acceleration measurements and other measurements of the drill bit condition. A suitable telemetry or communication sub 72 using, for example, two-way telemetry, is also provided as illustrated in the drilling assembly 90. The drilling sensor module processes the sensor information and transmits it to the surface control unit 40 via the telemetry system 72.

The communication sub 72, a power unit 78 and an MWD tool 79 are all connected in tandem with the drillstring 20. Flex subs, for example, are used in connecting the MWD tool 79 in the drilling assembly 90. Such subs and tools form the bottom hole drilling assembly 90 between the drillstring 20 and the drill bit 50. The drilling assembly 90 makes various measurements including the pulsed nuclear magnetic resonance measurements while the borehole 26 is being drilled. The communication sub 72 obtains the signals and measurements and transfers the signals, using two-way telemetry, for example, to be processed on the surface. Alternatively, the signals can be processed using a downhole processor in the drilling assembly 90.

The surface control unit or processor 40 also receives signals from other downhole sensors and devices and signals from sensors $S_1$-$S_3$ and other sensors used in the system 10 and processes such signals according to programmed instructions provided to the surface control unit 40. The surface control unit 40 displays desired drilling parameters and other information on a display/monitor 42 utilized by an operator to control the drilling operations. The surface control unit 40 typically includes a computer or a microprocessor-based processing system, memory for storing programs or models and data, a recorder for recording data, and other peripherals. The control unit 40 is typically adapted to activate alarms 44 when certain unsafe or undesirable operating conditions occur. The system also includes a downhole processor, sensor assembly for making formation evaluation and an orientation sensor. These may be located at any suitable position on the bottom hole assembly (BHA).

FIG. 2*a* is a schematic view of the pulser, also called an oscillating shear valve, assembly 19, for mud pulse telemetry. The pulser assembly 19 is located in the inner bore of the tool housing 101. The housing 101 may be a bored drill collar in the bottom hole assembly 10, or, alternatively, a separate housing adapted to fit into a drill collar bore. The drilling fluid 31 flows through the stator 102 and rotor 103 and passes through the annulus between the pulser housing 108 and the inner diameter of the tool housing 101.

The stator 102, see FIGS. 2*a* and 2*b*, is fixed with respect to the tool housing 101 and to the pulser housing 108 and has multiple lengthwise flow passages 120. The rotor 103, see FIGS. 2*a* and 2*c*, is disk shaped with notched blades 130 creating flow passages 125 similar in size and shape to the flow passages 120 in the stator 102. Alternatively, the flow passages 120 and 125 may be holes through the stator 102 and the rotor 103, respectively. The rotor passages 125 are adapted such that they can be aligned, at one angular position with the stator passages 120 to create a straight through flow path. The rotor 103 is positioned in close proximity to the stator 102 and is adapted to rotationally oscillate. An angular displacement of the rotor 103 with respect to the stator 102 changes the effective flow area creating pressure fluctuations in the circulated mud column. To achieve one pressure cycle it is necessary to open and close the flow channel by changing the angular positioning of the rotor blades 130 with respect to the stator flow passage 120. This can be done with an oscillating movement of the rotor 103. Rotor blades 130 are rotated in a first direction until the flow area is fully or partly restricted. This creates a pressure increase. They are then rotated in the opposite direction to open the flow path again. This creates a pressure decrease. The required angular displacement depends on the design of the rotor 103 and stator 102. The more flow paths the rotor 103 incorporates, the less the angular displacement required to create a pressure fluctuation is. A small actuation angle to create the pressure drop is desirable. The power required to accelerate the rotor 103 is proportional to the angular displacement. The lower the angular displacement is, the lower the required actuation power to accelerate or decelerate the rotor 103 is. As an example, with eight flow openings on the rotor 103 and on the stator 102, an angular displacement of approximately 22.5° is used to create the pressure drop. This keeps the actuation energy relatively small at high pulse frequencies. Note that it is not necessary to completely block the flow to create a pressure pulse and therefore different amounts of blockage, or angular rotation, create different pulse amplitudes.

The rotor 103 is attached to shaft 106. Shaft 106 passes through a flexible bellows 107 and fits through bearings 109 which fix the shaft in radial and axial location with respect to housing 108. The shaft is connected to a electrical motor 104, which may be a reversible brushless DC motor, a servomotor, or a stepper motor. The motor 104 is electronically controlled, by circuitry in the electronics module 135, to allow the rotor 103 to be precisely driven in either direction. The precise control of the rotor 103 position provides for specific shaping of the generated pressure pulse. Such motors are commercially available and are not discussed further. The electronics module 135 may contain a programmable processor which can be preprogrammed to transmit data utilizing any of a number of encoding schemes which include, but are not limited to, Amplitude Shift Keying (ASK), Frequency Shift Keying (FSK), or Phase Shift Keying (PSK) or the combination of these techniques.

In one embodiment of the invention, the tool housing 101 has pressure sensors, not shown, mounted in locations above and below the pulser assembly, with the sensing surface exposed to the fluid in the drill string bore. These sensors are powered by the electonics module 135 and can be for receiving surface transmitted pressure pulses. The processor in the electronics module 135 may be programmed to alter the data encoding parameters based on surface transmitted pulses. The encoding parameters can include type of encoding scheme, baseline pulse amplitude, baseline frequency, or other parameters affecting the encoding of data.

The entire pulser housing 108 is filled with appropriate lubricant 111 to lubricate the bearings 109 and to pressure compensate the internal pulser housing 108 pressure with the downhole pressure of the drilling mud 31. The bearings 109 are typical anti-friction bearings known in the art and are not described further. In one embodiment, the seal 107 is a flexible bellows seal directly coupled to the shaft 106 and the pulser housing 108 and hermetically seals the oil filled pulser housing 108. The angular movement of the shaft 106 causes the flexible material of the bellows seal 107 to twist thereby accommodating the angular motion. The flexible bellows material may be an elastomeric material or, alternatively, a fiber reinforced elastomeric material. It is necessary to keep the angular rotation relatively small so that the bellows material will not be overstressed by the twisting motion. In an alternate preferred embodiment, the seal 107 may be an elastomeric rotating shaft seal or a mechanical face seal.

In one embodiment, the motor 104 is adapted with a double ended shaft or alternatively a hollow shaft. One end of the motor shaft is attached to shaft 106 and the other end of the motor shaft is attached to torsion spring 105. The other end of torsion spring 105 is anchored to end cap 115. The torsion spring 105 along with the shaft 106 and the rotor 103 comprise a mechanical spring-mass system. The torsion spring 105 is designed such that this spring-mass system is at its natural frequency at, or near, the desired oscillating pulse frequency of the pulser. The methodology for designing a resonant torsion spring-mass system is well known in the mechanical arts and is not described here. The advantage of a resonant system is that once the system is at resonance, the motor only has to provide power to overcome external forces and system dampening, while the rotational inertia forces are balanced out by the resonating system.

Figure 3:
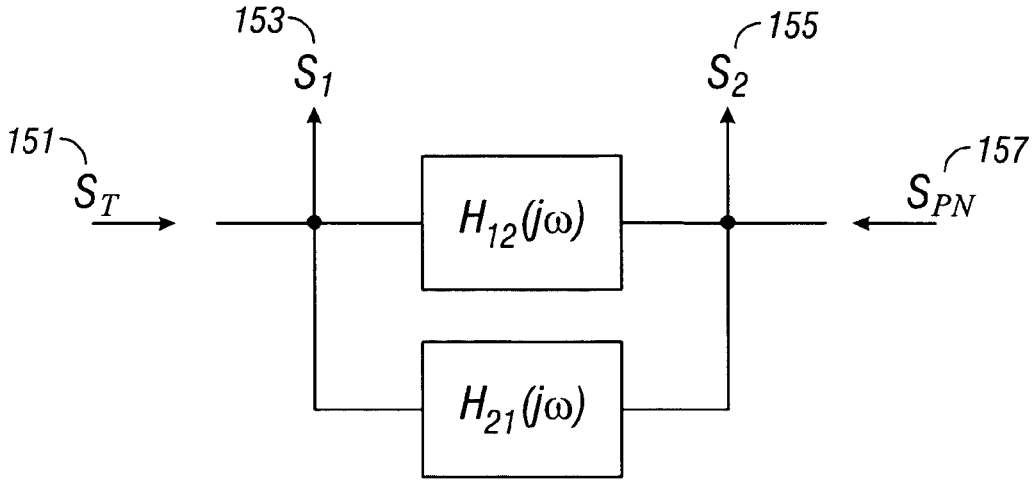
FIG. 3 is an illustration of the channel transfer function.

Turning now to FIG. 3, a block diagram showing the propagation of signals is shows. Denoted by 151 and 157 are the telemetry (message) signal $S_T$ and the pump noise $s_{PN}$. The signals are detected by two sensors $s_1$ and $s_2$ (153, 155 respectively). The mixture of the telemetry signal $S_T$ and pump noise $s_{PN}$, both signal waves traveling in opposite direction through the system with the transfer functions $H_{12}(j\omega)$ and $H_{21}(j\omega)$ for each direction, will be measured by two sensors as $$s_1(t)=s_T+F^{-1}(H_{21}(j\omega))*s_{PN},$$

$$s_2(t)=s_{PN}+F^{-1}(H_{12}(j\omega))*s_T \tag{1}$$

where $F^1$ is the inverse Fourier transform and * is the convolution operator.

In a first step the impedance between these two sensors is evaluated in the absence of any telemetry signals $s_T(\Delta T)=0$ in a time interval $\Delta T$. The complex impedance $I_{21}(j\omega)$ can be generated by Fourier transforming the signals $s_1(\Delta T)$, $s_2(\Delta T)$ and a division:

$$I_{21}(j\omega)=\frac{F(s_1(\Delta T))}{F(s_2(\Delta T))}=H_{21}(j\omega). \tag{2}$$

Next, a differential filtering of the signals is performed:

$$s_{out}=s_1-F^{-1}(I_{21}(j\omega))*s_2 \tag{3}$$

By the definition of $I_{21}$, this differential filtering will give a value of $s_{out}=0$ over the time interval ΔT. This method may be called zero-forcing. Outside the time interval ΔT, the differential filtering gives $$\begin{aligned} s_{out} &= s_1 - I_{21}s_2 \\ &= s_T + H_{21}s_{PN} - I_{21}(s_{PN} + H_{12}s_T) \\ &= s_T(1 - H_{21}H_{12}). \end{aligned} \tag{3}$$

In one embodiment of the invention, an assumption is made that $H_{21}=H_{12}$. With this assumption, the telemetry signal may be recovered as $$s_T = \frac{1}{(1 - H_{21}^2)}s_{out}. \tag{4}$$

The term $$\frac{1}{(1 - H_{21}^2)}$$

may be referred to as a model-based equalizer for the telemetry signal.

In another embodiment of the invention, instead of using zero-forcing, the filter is directly calculated by minimizing the error function $$\epsilon^2=(s_1-I_{21}^{LMS}*s_2)^2, \tag{5}$$

where the filter $I_{21}^{LMS}$ is obtained using the minimization procedure such as that described, for example, in "Adaptive Filter by G. Moschytz and M. Hofbauer, Springer Verlag, Berlin, October 2000". Using this filter, the differential filtered signal is:

$$s_{out}=s_1-I_{21}^{LMS}*s_2. \tag{6}$$

In another embodiment of the invention, no assumption is made about the relation between $H_{21}$ and $H_{12}$. Instead, a known reference signal is sent through the communication channel and the filter is calculated from the received signal. This results in equalization that includes the effect of the pulser, the mud channel, etc.

Figure 4:
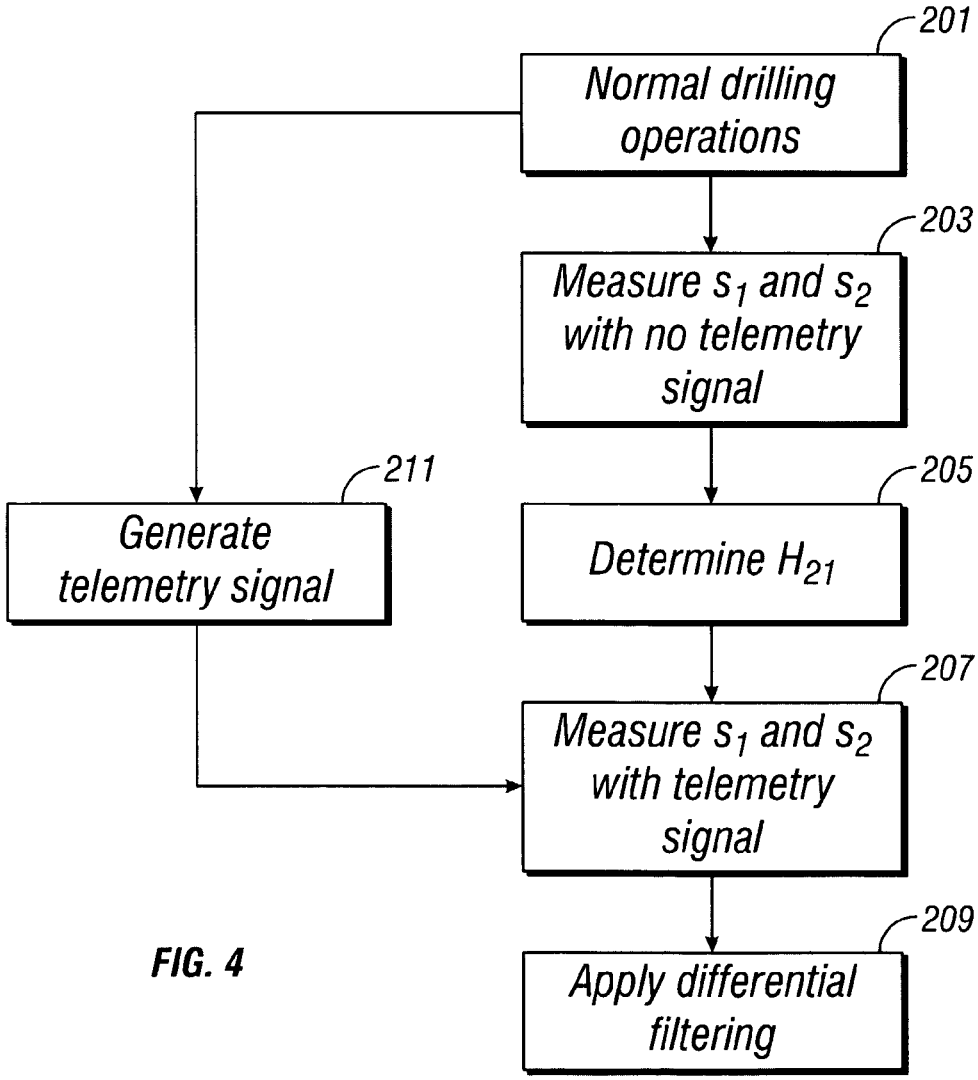
FIG. 4 is a flow chart of one embodiment of the method of the present invention.

A flow chart illustrating the method discussed above is given in FIG. 4. During normal drilling operations 201 the signals $s_1$ and $s_2$ are measured with no telemetry signal 203. The transfer function $H_{21}$ is determined 205 using eqn. (2). Measurements of $s_1$ and $s_2$ are then made with the telemetry signal 211 present 207. By applying the differential filtering 209 given by eqn. (3), eqn, the telemetry signal is recovered.

Figure 5:
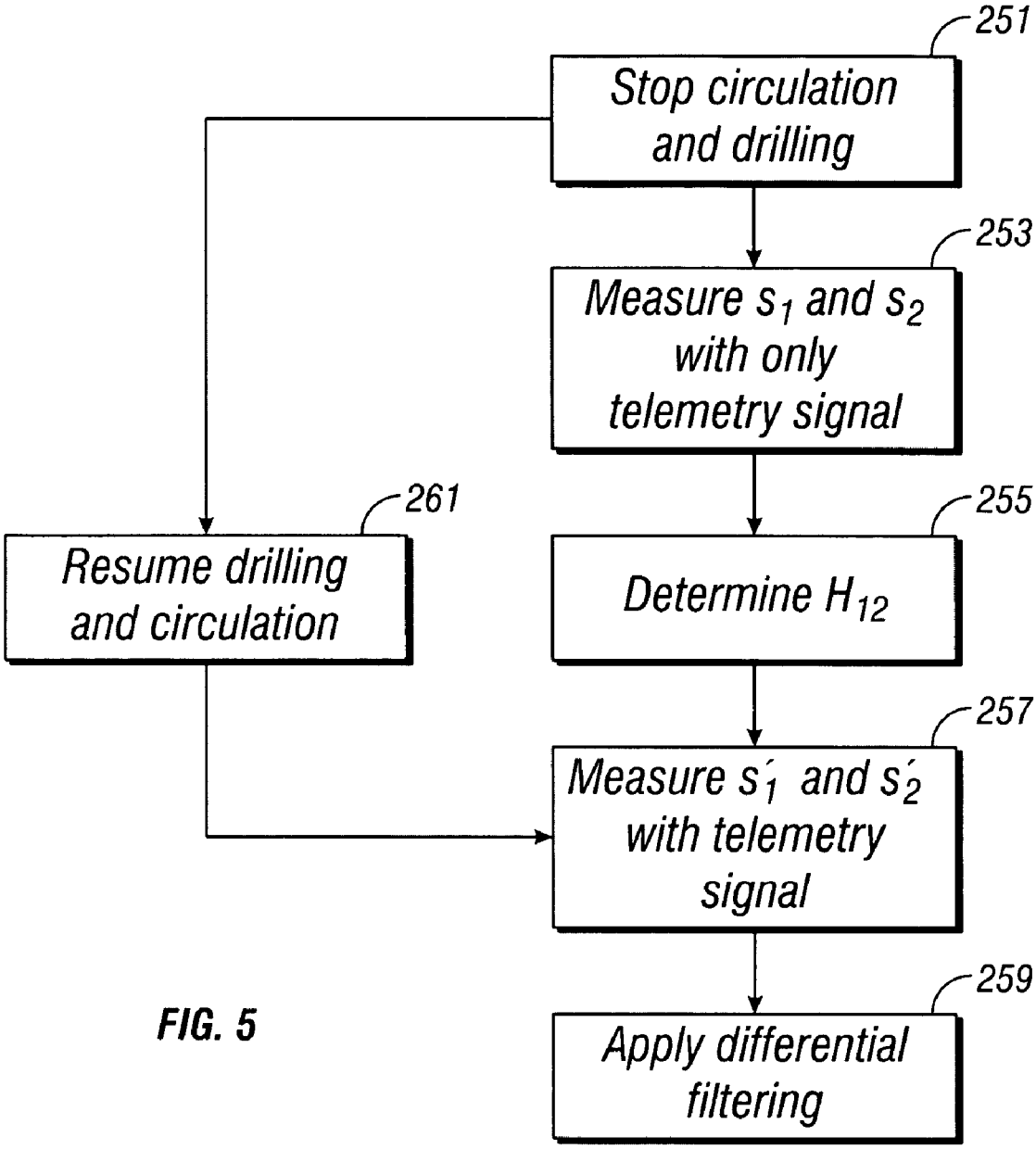
FIG. 5 is a flow chart of another embodiment of the method of the present invention.

In another embodiment of the invention, the assumption that $H_{21}=H_{12}$ is not made. Instead the impedance between these two sensors is evaluated in the absence of any pump noise $s_{PN}(\Delta T)=0$ in a time interval ΔT. The complex impedance $I_{12}(j\omega)$ can be generated by Fourier transforming the signals $s'_1(\Delta T)$, $s'_2(\Delta T)$ and a division:

$$I_{12}(j\omega) = \frac{F(s'_1(\Delta T))}{F(s'_2(\Delta T))} = H_{12}(j\omega), \tag{5}$$

which gives a direct measurement of $H_{12}$, This is illustrated in the flow chart of FIG. 5. Circulation and drilling is stopped 251 and the signals $s'_1(\Delta T)$ are $s'_2(\Delta T)$ measured in the presence of only a telemetry signal 253. The transfer function $H_{12}$ is determined 255. Measurements of $s'_1$ and $s'_2$ are then made with the drilling and circulation resumed 261 and the telemetry signal present 257. By applying the differential filtering 259, the telemetry signal is recovered. An auxiliary power source such as a battery may be necessary to operate the downhole mud pulser when there is no mud circulating. As an alternative to the zero-forcing of eqn. (5), a least means square approach may also be used.

Figure 6A:
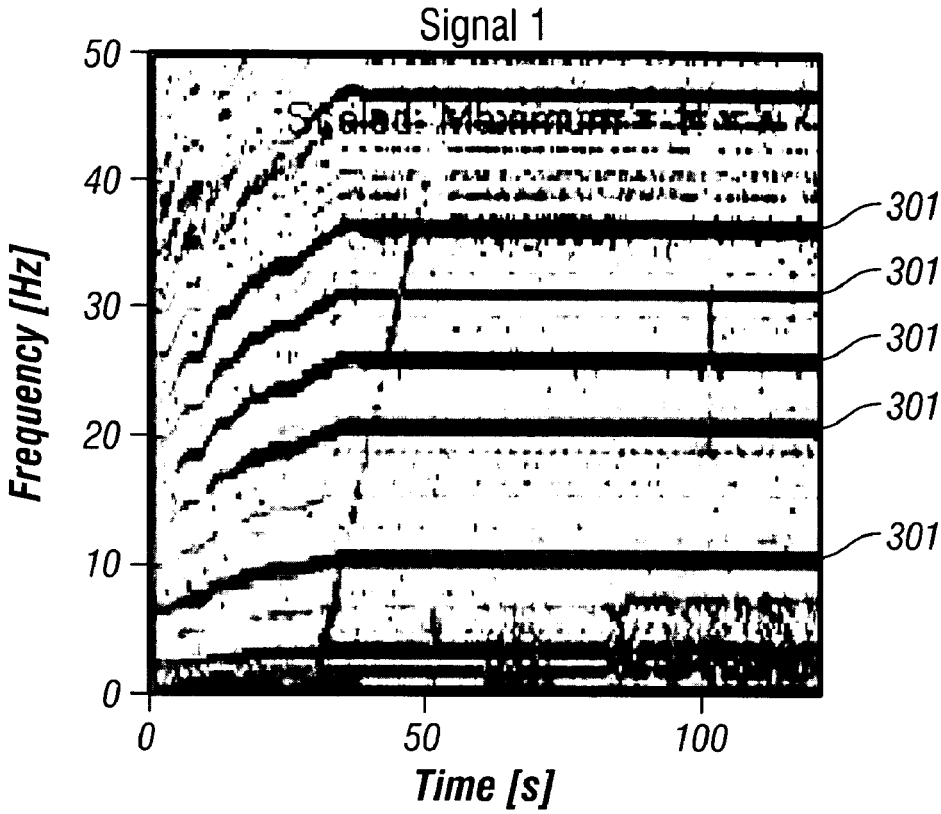
FIGS. 6*a* and 6*b* show exemplary signals measured at two spaced apart locations resulting from simultaneous activation of a message source and a noise source.
Figure 6B:
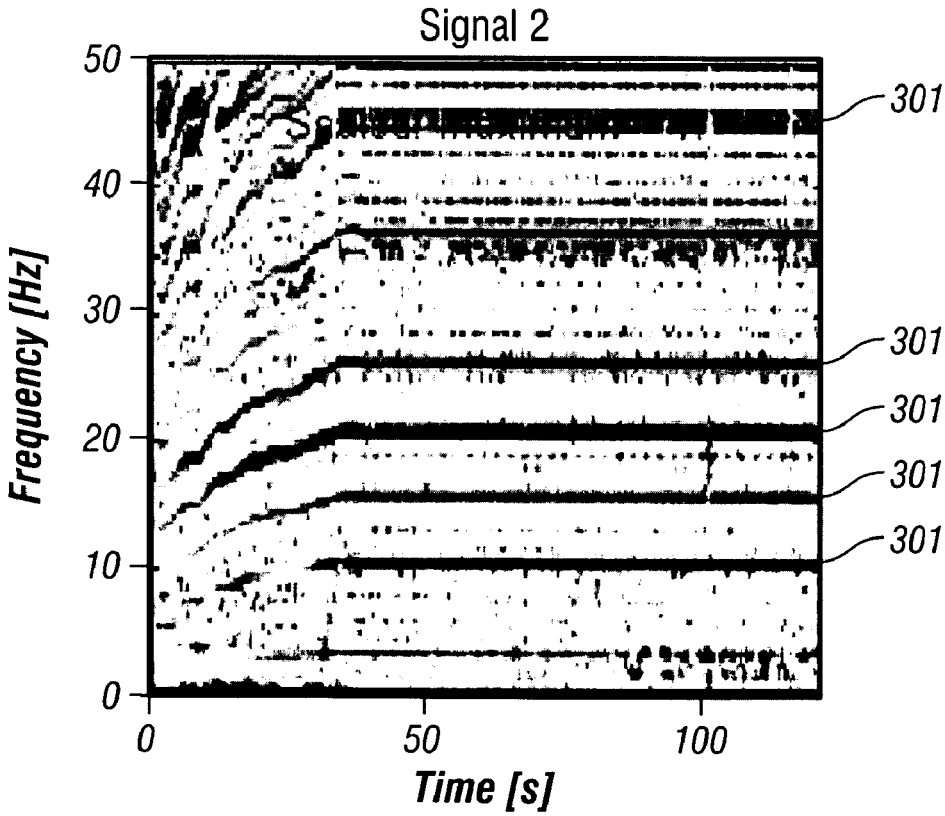
Figure 6C:
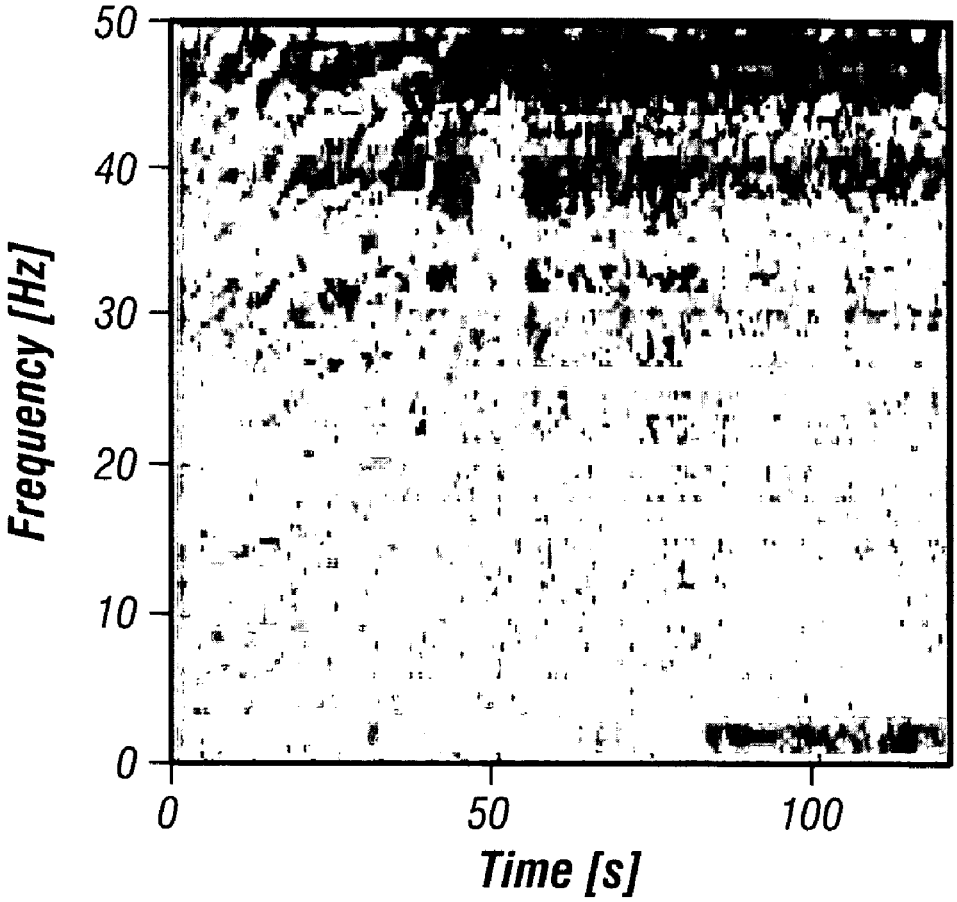
FIG. 6*c* shows the result of processing the signals of FIGS. 6*a* and 6*b* using the method of the present invention.

In yet another embodiment of the invention, the direction of flow may be reversed with only the pumps operating, and another estimate of the transfer function between the two sensors obtained. The pumps are connected to the Kelly hose to flow in the opposite direction FIGS. 6*a* and 6*b* show exemplary signals recorded with pump noise 301 present. The abscissa in both figures is time and the ordinate is frequency. A swept frequency telemetry signal was used. FIG. 6*c* shows the recovered spectrum of the telemetry signal after applying the method discussed above with the assumption that $H_{21}=H_{12}$. The reduction in the pump noise is significant.

The operation of the transmitter and receivers may be controlled by the downhole processor and/or the surface processor. Implicit in the control and processing of the data is the use of a computer program on a suitable machine readable medium that enables the processor to perform the control and processing. The machine readable medium may include ROMs, EPROMs, EAROMs, Flash Memories and Optical disks.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. A method of communicating a signal through a fluid in a borehole between a first location and a second location, the method comprising:

(a) measuring signals in the fluid at at least two spaced apart positions at or near the second location in response to operation of at least one of (A) a noise source, and, (B) a message source;

(b) estimating from the signals at the at least two spaced apart positions a characteristic of a fluid channel between the at least two spaced apart positions;

(c) generating a message signal simultaneously with operation of the noise source;

(d) measuring additional signals at the at least two positions responsive to the message signal and the simultaneous operation of the noise source; and (e) estimating the message signal from the additional signals and the estimated fluid characteristic.

2. The method of claim 1 wherein the signals at the at least two spaced apart locations comprise at least one of (i) pressure signals, and, (ii) flow rate signals.

3. The method of claim 1 wherein the noise source is on a side of the first and second positions opposite to the first location.

4. The method of claim 1 wherein the characteristic of the fluid comprises a transfer function between the at least two spaced apart positions.

5. The method of claim 1 wherein estimating the characteristic of the fluid further comprises performing a unitary transform of the signals at the at least two spaced apart locations.

6. The method of claim 1 wherein estimating the message signal further comprises performing a differential filtering based on one of (i) a zero forcing, and (ii) a least squares minimization.

7. The method of claim 1 wherein generating the message signal further comprises at least one of (i) Amplitude Shift Keying (ASK), (ii) Frequency Shift Keying (FSK), and, (iii) Phase Shift Keying (PSK).

8. The method of claim 1 wherein the message signal further comprises a swept frequency signal.

9. A system for communicating a signal through a fluid in a borehole between a bottomhole assembly (BHA) and a surface location, the system comprising:

(a) a message source on the bottomhole assembly (BHA) configured to generate a message signal;

(b) sensors at at least two spaced apart positions configured to measure signals in response to operation of at least one of (A) a noise source, and, (B) the message source; and (c) a processor configured to estimate from the signals a characteristic of a fluid channel between the at least two spaced apart positions;

wherein the sensors at the at least two spaced apart positions are further configured to receive additional signals responsive to a message signal at the downhole location generated simultaneously with operation of the noise source; and wherein the processor is further configured to estimate the message signal from the additional signals and the estimated fluid characteristic.

10. The system of claim 9 wherein the signals at the at least two spaced apart positions are selected from the group consisting of (i) pressure signals, and, (ii) flow rate signals.

11. The system of claim 9 wherein the noise source is on a side of the at least two spaced apart positions opposite to the message source.

12. The system of claim 9 wherein the characteristic of the fluid comprises a transfer function between the at least two spaced apart positions.

13. The system of claim 9 wherein in estimating the characteristic of the fluid the processor is further configured to perform a unitary transform of the signals at the at least two spaced apart positions.

14. The system of claim 13 wherein the unitary transform comprises a Fourier transform.

15. The system of claim 9 wherein in estimating the message signal the processor is further configured to perform a differential filtering based on one of (i) a zero forcing, and (ii) a least squares minimization.

16. The system of claim 9 wherein generating the message signal further comprises at least one of (i) Amplitude Shift Keying (ASK), (ii) Frequency Shift Keying (FSK), and, (iii) Phase Shift Keying (PSK).

17. The system of claim 9 wherein the message signal further comprises a swept frequency signal.

18. The system of claim 9 further comprising a drilling tubular configured to convey the BHA into the borehole.

19. The system of claim 9 wherein the message source comprises an oscillating valve.

20. A machine readable medium for use in conjunction with a bottomhole assembly (BHA), conveyed in a borehole in an earth formation, the medium encoded with instructions which enable:

(a) estimating from signals in a fluid at at least two spaced apart positions at or near a surface location in response to operation of at least one of (A) a noise source, and, (B) a message source at the downhole location, a characteristic of a fluid channel between the at least two spaced apart positions;

(b) estimating a value of a message signal generated at the BHA simultaneously with operation of the noise source from:

(A) additional signals measured at the at least two spaced apart positions responsive to operation of the message source and the simultaneous operation of the noise source, and (B) the estimated fluid channel characteristic.

21. The machine readable medium of claim 20 further comprising at least one of (i) a ROM, (ii) an EPROM, (iii) an EAROM, (iv) a Flash Memory, and, (v) an Optical disk.

22. The machine readable medium of claim 20 further comprising instructions for performing a unitary transform of the first and second signals.

23. The machine readable medium of claim 20 further comprising instructions for performing a differential filtering.

24. The machine readable medium of claim 20 wherein generating the message signal further comprises at least one of (i) Amplitude Shift Keying (ASK), (ii) Frequency Shift Keying (FSK), and, (iii) Phase Shift Keying (PSK).

25. The machine readable medium of claim 20 further comprising instructions for generating the message signal in response to at least one of (i) a measurement of a parameter of the BHA, and, (ii) a measurement of a property of the earth formation.

* * * * *

UNITED STATES PATENT AND TRADEMARK OFFICE

CERTIFICATE OF CORRECTION

PATENT NO. : 7,423,550 B2
APPLICATION NO. : 11/311196
DATED : September 9, 2008
INVENTOR(S) : Hanno Reckmann, Michael Neubert and Ingolf Wasserman It is certified that error appears in the above-identified patent and that said Letters Patent is hereby corrected as shown below:

Column 10, line 66, delete “locations” and insert --positions--;

Column 11, lines 9 and 10, delete “locations” and insert --positions--;

Column 11, line 36, delete “at the downhole”and insert --at a downhole--; and

Column 12, line 24, delete “at the downhole”and insert --at a downhole--.

Signed and Sealed this

Thirteenth Day of January, 2009

JON W. DUDAS
*Director of the United States Patent and Trademark Office*